US007776804B2

(12) United States Patent
Huang et al.

(10) Patent No.: US 7,776,804 B2
(45) Date of Patent: Aug. 17, 2010

(54) VISCOSITY IMPROVER COMPOSITIONS PROVIDING IMPROVED LOW TEMPERATURE CHARACTERISTICS TO LUBRICATING OIL

(75) Inventors: Chor Huang, Avon Lake, OH (US); Lewis Breon, Aurora, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 837 days.

(21) Appl. No.: 11/085,022

(22) Filed: Mar. 16, 2005

(65) Prior Publication Data

US 2006/0211586 A1 Sep. 21, 2006

(51) Int. Cl.
*C10M 143/10* (2006.01)
*C10M 143/12* (2006.01)
*C10M 143/04* (2006.01)

(52) U.S. Cl. ..... 508/591; 508/110

(58) Field of Classification Search ..... 508/110, 508/591

See application file for complete search history.

(56) References Cited

U.S. PATENT DOCUMENTS

| | | | | |
|---|---|---|---|---|
| 3,509,056 | A | 4/1970 | Shepherd | 252/59 |
| 3,775,329 | A | 11/1973 | Eckert | 252/59 |
| 4,113,636 | A * | 9/1978 | Engel et al. | 508/316 |
| 4,194,057 | A | 3/1980 | Brankling et al. | 585/11 |
| 4,509,821 | A | 4/1985 | Stenger | 350/95.23 |
| 4,908,146 | A | 3/1990 | Smith | 252/56 |
| 4,933,099 | A | 6/1990 | VerStrate | 252/51.5 |
| 5,458,791 | A * | 10/1995 | Rhodes et al. | 508/591 |
| 5,458,792 | A | 10/1995 | Rhodes et al. | 252/43 |
| 5,747,433 | A * | 5/1998 | Luciani et al. | 508/479 |
| 6,403,710 | B1 | 6/2002 | Ahmed et al. | 525/98 |
| 6,525,007 | B2 | 2/2003 | Okada et al. | 508/591 |
| 6,528,694 | B1 | 3/2003 | Chiga | |

FOREIGN PATENT DOCUMENTS

| | | |
|---|---|---|
| EP | 0 690 082 | 8/1997 |
| EP | 1178102 | 2/2002 |
| GB | 2048935 | 12/1980 |
| JP | 53-25608 | 3/1978 |
| WO | WO96/17041 | 6/1996 |
| WO | WO 00 58423 | 5/2000 |
| WO | WO 00 34420 | 6/2000 |
| WO | WO02/10276 | 2/2002 |
| WO | WO 0210276 A2 * | 2/2002 |

* cited by examiner

*Primary Examiner*—Glenn Caldarola
*Assistant Examiner*—Jim Goloboy
(74) *Attorney, Agent, or Firm*—David M. Shold; Christopher D. Hilker

(57) ABSTRACT

A lubricant composition comprising an oil of lubricating viscosity; (A) 0.05 to 1.5 percent by weight of a copolymer comprising 70 to 79 percent by weight of units derived from ethylene ("E"), having a $\overline{M}w$ of 50,000 to 100,000, $\overline{M}w/\overline{M}n$ less than 3, density ("D") of 860 to 896 kg/m$^3$, and a melting point ("$T_m$") of 15° C. to 60° C., wherein E and $T_m$ fulfill the expression $$3.44E-206 \geqq T_m;$$

and (B) 0.05 to 1.5 percent by weight of a block- copolymer comprising a first block which comprises a vinyl aromatic comonomer and a second block which comprises a diene comonomer, the diene monomer-containing block being hydrogenated; wherein the weight ratio (A):(B) is 20:80 to 60:40; exhibits good low temperature performance and durability.

12 Claims, No Drawings

VISCOSITY IMPROVER COMPOSITIONS PROVIDING IMPROVED LOW TEMPERATURE CHARACTERISTICS TO LUBRICATING OIL

This application claims priority from U.S. Provisional Application 60/458,666, Mar. 28, 2003.

FIELD OF THE INVENTION

This invention relates to polymeric compositions. More particularly, the invention relates to mixtures of relatively low molecular weight ethylene copolymers having certain characteristics and a vinyl aromatic block copolymer. These polymers are useful as viscosity improvers for lubricating oils.

BACKGROUND OF THE INVENTION

The viscosity of oils of lubricating viscosity is generally dependent upon temperature. As the temperature of the oil is increased, the viscosity usually decreases, and as the temperature is reduced, the viscosity usually increases.

The function of a viscosity improver (viscosity modifier, or viscosity index improver) is to reduce the extent of the decrease in viscosity as the temperature is raised or to reduce the extent of the increase in viscosity as the temperature is lowered, or both. Thus, a viscosity improver ameliorates the change of viscosity of an oil containing it with changes in temperature. The fluidity characteristics of the oil are improved since the oil maintains a more consistent viscosity over a wider range of temperatures.

It is desirable that the viscosity improver not adversely affect the low-temperature viscosity of the lubricant containing same. Frequently, while many viscosity improvers enhance the high temperature viscosity characteristics of lubricating oil, the low temperature properties of the treated lubricant become worse.

Additives that provide viscosity improving properties are known in the art. Such products are described in numerous publications including C. V. Smalheer and R. K. Smith "Lubricant Additives," Lezius-Hiles Co. (1967).

International Patent Publication No. WO 02/10276, Feb. 7, 2002, discloses a mixture comprising A) a copolymer comprising about 70 to 79% by weight of units derived from ethylene, and having (a) $\overline{M}_w$ of 50,000 up to less than 130,000 and/or (f) SSI≦18; (b) density (D) of about 845 to about 895 kg/m$^3$; (c) $\overline{M}_w/\overline{M}_n$ less than 3; (d) melting point ($T_m$) of about 15° C. to about 60° C.; and (e) degree of crystallinity≧1.5%, and B) an amorphous polymer having certain $\overline{M}_w$ and crystallinity properties. Also, additive concentrates and lubricating compositions comprising the components making up the mixture are disclosed.

It is also common that viscosity modifiers, which are typically polymeric materials are supplied in the form of a concentrate in oil, for convenience in use and handling. It is desirable for economic reasons that the concentration of the viscosity modifier in the concentrate be as high as possible, while retaining a reasonable viscosity so that the concentrate can be readily handled, e.g., poured or pumped. However, it has been observed that certain viscosity modifiers, in particular, certain hydrogenated styrene-diene block copolymers, e.g., styrene-isoprene block copolymers and star copolymers, cannot be used in concentrates at concentrations greater than about 6% by weight, since they lead to extremely high kinematic viscosities at 100° C., e.g., values in excess of 10,000 mm$^2$/s (cSt), while ideally viscosities less than about 1000 mm$^2$/s (cSt) are desirable.

Such hydrogenated diene/vinyl aromatic polymers are known, and concentrates of such polymers of improved viscosity are also known. U.S. Pat. No. 5,747,433, Luciani et al., May 5, 1998, discloses a composition of about 2 to about 20 percent of a hydrogenated diene/vinyl aromatic block copolymer and a selected non-ionic surface active agent, in a medium of oil of lubricating viscosity, which exhibits reduced viscosity compared with comparable compositions without the surface active agent.

U.S. Pat. No. 4,194,057, Brankling et al, Mar. 18, 1980, discloses a viscosity index improver additive composition containing a vinyl aromatic/conjugated diene polymer and an ethylene $C_3$ to $C_{18}$ alpha olefin copolymer.

U.S. Pat. No. 6,525,007, Okada et al., Feb. 25, 2003, discloses a viscosity modifier for lubricating oil, comprising an ethylene/propylene copolymer having 70-79% recurring units derived from ethylene, a weight average molecular weight of 80,000 to 250,000 and certain Mw/Mn and melting point characterizations. Other materials can be present, including as pour point depressants, copolymers of α-olefins and styrene.

European Patent Application EP 1 178 102, Feb. 6, 2002, discloses a lubricating oil composition of a lubricating base oil and a copolymer of ethylene and an α-olefin of 3 to 20 carbon atoms, having an ethylene content of 40-77% by weight and other characterizing parameters. Pour point depressants can also be present, such as copolymers of α olefins and styrene.

PCT Publication WO 96/17041, Jun. 6, 1996, discloses polymer blends containing olefin copolymers and star branched polymers, useful for improving the viscosity index of lubricating oils. The olefin copolymers can be ethylene-propylene copoivmer. The star polymers can be styrene/isoprene based polymers.

The present invention provides a blend of polymers such that high total levels of polymer in a concentrate can be employed, including relatively high levels of hydrogenated styrene-diene block copolymers, without leading to excessive concentrate viscosity. Moreover, in many instances the present invention provides unexpectedly good shear stability and low temperature performance to lubricant formulations.

SUMMARY OF THE INVENTION

The present invention provides a lubricant composition comprising: an oil of lubricating viscosity; (A) 0.05 to 1.5 percent by weight of a copolymer comprising 70 to 79 percent by weight of units derived from ethylene ("E"), having a $\overline{M}_w$ of 50,000 to 100,000, $\overline{M}_w/\overline{M}_n$ less than about 3, density ("D") of 860 to 896 kg/m$^3$, and a melting point ("$T_m$") of 15° C. to 60° C., wherein E and $T_m$ fulfill the expression $$3.44E-206 \geqq T_m;$$

and (B) 0.05 to 1.5 percent by weight of a block copolymer comprising a first block which comprises a vinyl aromatic comonomer and a second block which comprises a diene comonomer, the diene monomer-containing block being hydrogenated; wherein the weight ratio (A):(B) is 20:80 to 60:40.

The invention also provides a concentrate comprising: an oil of lubricating viscosity; (A) 1 to 30 percent by weight of the above-described copolymer (A), and (B) 1 to 30 percent by weight of the above-described block copolymer (B); wherein the weight ratio (A):(B) is 20:80 to 60:40.

Also provided is a solid polymeric composition comprising: (A) 20 to 60 percent by weight of the above-described copolymer (A) and (B) 40 to 80 percent by weight of the above-described block copolymer (B).

The present invention also provides a method for lubricating an internal combustion engine, comprising supplying thereto the above lubricant composition.

DETAILED DESCRIPTION OF THE INVENTION

As used herein, the term "hydrocarbon" means a group which is purely hydrocarbon, that is, a compound of hydrogen and carbon containing no hetero atoms. The terms "hydrocarbyl" and "hydrocarbon based" means that the group being described has predominantly hydrocarbon character within the context of this invention. Hydrocarbyl and hydrocarbon based groups include groups that are purely hydrocarbon in nature, that is, they contain only carbon and hydrogen. They may also include groups containing non-hydrocarbon substituents or atoms which do not alter the predominantly hydrocarbon character of the group. Such substituents may include halo-, alkoxy-, and nitro-. These groups also may contain hetero atoms. Suitable hetero atoms will be apparent to those skilled in the art and include, for example, sulfur, nitrogen and oxygen. Therefore, while remaining predominantly hydrocarbon in character within the context of this invention, these groups may contain atoms other than carbon present in a chain or ring otherwise composed of carbon atoms. Thus, the terms "hydrocarbyl" and "hydrocarbon based" are broader than the term "hydrocarbon" since all hydrocarbon groups are also hydrocarbyl or "hydrocarbon based" groups while hydrocarbyl groups or hydrocarbon based groups containing hetero atoms are not hydrocarbon groups as defined herein.

In general, no more than three non-hydrocarbon substituents or hetero atoms, and preferably no more than one, will be present for every 10 carbon atoms in hydrocarbyl or hydrocarbon based groups. Most preferably, these groups are purely hydrocarbon in nature, that is they are essentially free of atoms other than carbon and hydrogen.

Throughout the specification and claims the expression oil soluble or dispersible is used. By oil soluble or dispersible is meant that an amount needed to provide the desired level of activity or performance can be incorporated by being dissolved, dispersed or suspended in an oil of lubricating viscosity. Usually, this means that at least 0.001% by weight of the material can be incorporated in a lubricating oil composition. For a further discussion of the terms oil soluble and dispersible, particularly "stably dispersible," see U.S. Pat. No. 4,320,019.

It must be noted that as used in this specification and appended claims, the singular forms also include the plural unless the context clearly dictates otherwise. Thus the singular forms "a", "an", and "the" include the plural; for example "an olefin" includes mixtures of olefins of the same type. As another example the singular form "olefin" is intended to include both singular and plural unless the context clearly indicates otherwise.

The Ethylene Copolymer

The mixtures and compositions of this invention comprise at least two polymers as set forth hereinabove and in greater detail hereinbelow. The first polymer is (A) a copolymer comprising 70 to 79% by weight of units derived from ethylene, and having (a) $\overline{M}_w$ measured by gel permeation chromatography employing polystyrene standard of 50,000 to 100,000, and typically (f) shear stability index (SSI) less than or equal to 50 or, preferably, ≦18, as determined employing ASTM Procedures D-6278 and D-6022. It will typically also have (b) density (D) of 860 to 895 kg/m$^3$; (c) $\overline{M}_w/\overline{M}_n$ less than 3; (d) melting point ($T_m$) measured by differential scanning calorimeter of 15° C. to 60° C. or alternatively 0° C. to 60° C. In one embodiment (e) the degree of crystallinity is ≧15%. In one embodiment the density (D) and the melting point fulfill the expression $T_m \leqq 1.247$ D-1037 and in another embodiment the percentage content (E: % by weight) of repeating units derived from ethylene and melting point ($T_m$: ° C.) of the copolymer A) fulfill the expression $3.44E\text{-}206 \geqq T_m$.

As used herein, the term "copolymer" means polymers having two or more comonomers, thus, including both binary copolymers, terpolymers, and higher polymers. The comonomers can include polar monomers used to impart dispersant functionality to the polymer.

The copolymer can be a substantially amorphous polymer (e.g., less than 5% crystallinity) or, preferably is a partially crystalline polymer having a degree of crystallinity of at least 15%, preferably 20% to 30% as measured by differential scanning calorimetry. Both differential scanning calorimitery (a form of differential thermal analysis) and X-ray diffraction techniques are useful for determining the degree of crystallinity of the polymers used in this invention. These procedures are well known to those skilled in the art and are described in, for example, U.S. Pat. No. 3,389,087. In the procedure described in this patent, differential thermal analysis indicated the presence of crystallinity and X-ray diffraction patterns indicated the degree of crystallinity. A discussion of crystallinity of polymers is given in various sections of Billmeyer, Jr., Text-book of Polymer Science, 3rd Ed., Wiley-Interscience, at, for example pp. 232-233, 240, 252, 286-289, 342-344, 399 and 420. A specific discussion of degree of crystallinity and methods for determining same appears at pp. 286-289.

Copolymer (A) comprises 70 to 79% by weight of units derived from ethylene, preferably by weight and more preferably, 74 to 76% by weight. The comonomer may be any monomer that is copolymerizable with ethylene but preferably, the comonomer comprises an olefin, particularly an olefin containing 3 to 18 carbon atoms, and more preferably, alpha-olefins. Propylene is an especially preferred comonomer, and in one embodiment the copolymer of (A) is an ethylene/propylene copolymer. In another embodiment, the first copolymer further comprises units derived from polyenes, preferably dienes, most preferably non-conjugated dienes. Typically, polyene-containing polymers may comprise 0.5 to 10 parts by weight of units derived from polyenes.

Ethylene content of the copolymer is measured using $^{13}C$ nuclear magnetic resonance (NMR).

The weight average molecular weight ($\overline{M}_w$) of the copolymer (A) is measured by gel permeation chromatography (GPC), also known as size-exclusion chromatography, employing polystyrene standard, and ranges from 50,000 to 100,000, more often 70,000 to 100,000 or 75,000 to 95,000 or 80,000 to 90,000.

The first copolymer has $\overline{M}_w/\overline{M}_n$, which is an index of molecular weight distribution, less than 3, preferably 1.5 to 2.2, wherein $\overline{M}_n$ is the number average molecular weight of the copolymer, also measured by GPC.

The GPC technique employs standard materials against which the samples are compared. For best results, standards that are chemically similar to those of the sample are used. For example, for polystyrene polymers, a polystyrene standard, preferably of similar molecular weight, is employed. When standards are dissimilar to the sample, generally relative molecular weights of related polymers can be determined. For example, using a polystyrene standard, relative, but not absolute, molecular weights of a series of polymethacrylates may be determined. These and other procedures are described in numerous publications including P. J. Flory, "Principles of Polymer Chemistry", Cornell University Press (1953), Chapter VII, pp 266-316.

The copolymer typically has density of 860 to 882 kg/m$^3$. ASTM Procedure D-1505 is frequently used to measure polymer density.

The melting point of the copolymer is 15° C. to 60° C., preferably 25° C. to 50° C. and more preferably 25-45° C. Melting point of the copolymer is determined employing a differential scanning calorimeter. The melting point is the temperature in the maximum peak position in the endothermic curve. The melting point is determined from the second run endothermic curve obtained by charging a sample into an aluminum pan, heating it to 200° C. at 10° C./minute, holding it at 200° C. for 5 minutes and thereafter cooling it to −150° C. at 20° C./minute and then heating it at 10° C./minute to obtain a second run endothermic curve. From the obtained curve, the melting point is determined.

In one embodiment, the copolymer satisfies the relationship of formula (I) between the density (D: kg/m$^3$) and melting point ($T_m$: ° C.) measured by differential scanning calorimeter:

$$T_m \leqq 1.247\,D - 1037 \quad \text{(I).}$$

In another embodiment, the copolymer satisfies the relationship of formula (II) between a percentage content (E: % by weight) of repeating units derived from ethylene and melting point ($T_m$: ° C.):

$$3.44E - 206 \geqq T_m. \quad \text{(II)}$$

The copolymer (A) can be prepared employing olefinic polymerization catalyst, including catalysts consisting of a transition metal compound such as vanadium, zirconium, or titanium, and organic aluminum compound (an organic aluminumoxy compound) and/or an ionized ionic compound. Preferred among these are vanadium type catalysts consisting of a solid vanadium compound and an organic aluminum compound and metallocene catalyst consisting of a metallocene compound of a transition metal selected from Group 4 of the Periodic Table of Elements, an organic aluminumoxy compound and an ionized ionic compound. Soluble vanadium compounds are represented by the general formulae $$VO(OR)_aX_b$$

or $$V(OR)_cX_d$$

wherein R is a hydrocarbon group, X is a halogen atom, and a, b, c and d are such that a is 0 to 3, b is 0 to 3, a+b is 2 to 3, c is 0 to 4, d is 0 to 4, and c+d is 3 to 4.

Organic aluminum compounds which constitute the vanadium type catalysts are represented by the general formula $$^{-}R^1_nAlX_{3-n}$$

wherein $R^1$ is a hydrocarbon group containing 1-15 carbon atoms, preferably 1-4 carbon atoms, X is H or halogen and n ranges from 1 to 3. $R^1$ groups include, for example, alkyl, cycloalkyl, and aryl.

The organic aluminum compounds include, specifically, trialkyl aluminums, alkenyl aluminums, trialkenyl aluminums, dialkyl aluminum halides, alkyl aluminum sesquihalides, alkyl aluminum halides, dialkyl aluminum hydrides and alkyl aluminum dihydrides.

Illustrative metallocene type catalysts include metallocene compounds of transition metals selected from Group 4 of the Periodic Table of Elements and specifically represented by the general formula $$ML_x$$

wherein M is a transition metal selected from Group 4 of the Periodic Table of Elements, preferably zirconium, titanium and hafnium and x is a valence of the transition metal, L is a ligand which coordinates with the transition metal, wherein at least one L is a ligand with a cyclopentadienyl backbone, which may have a substituent. Examples of ligands include, alkyl- or cycloalkyl-substituted cyclopentadienyl groups, an indenyl group, a 4,5,6,7-tetrahydroindenyl group, and a fluorenyl group. These groups may be substituted with halogen or trialkylsilyl groups. Especially preferred are alkyl-substituted cyclopentadienyl groups.

When the metallocene compound has two or more groups with a cyclopentadienyl backbone as the ligand L, two of these groups with a cyclopentadienyl backbone may be bonded to each other via an alkylene group, a substituted alkylene group or a silylene group or a substituted silylene group. The L ligands other than those with a cyclopentadienyl backbone include hydrocarbon groups of 1-12 carbon atoms, including alkyl, cycloalkyl, aryl, aralkyl an the like; alkoxy groups; aryloxy groups; sulfonic-acid containing groups, halogen and H.

A compound represented by the general formula $$L^1M^1X_2$$

wherein M is a metal selected from Group 4 of the Periodic Table of Elements or lanthanides, $L^1$ is a derivative of a non-localized π bonding group which imparts a constraint geometric formation the metal $M^1$ active site, each X is, independently, H, halogen, hydrocarbon containing less than 20 carbon atoms, silicon, germanium, silyl or germanyl. Among compounds of this type, preferred are those represented by the general formula (III):

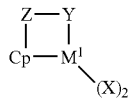

(III)

wherein $M^1$ is titanium, hafnium or zirconium and X is defined hereinabove. $C_p$ is a substituted cyclopentadienyl group which is π bonded to $M^1$ and has a substituent Z, wherein Z is sulfur, oxygen, boron or an element of Group 14 of the Periodic Table of Elements, Y is a ligand containing phosphorus, nitrogen or sulfur and Z and Y may form a fused ring. The metallocene compounds may be used individually or in combination.

A preferred metallocene compound of formula $ML_x$ is a zirconocene compound with a ligand containing at least two cyclopentadienyl backbones in which the center metallic atom is zirconium. In another preferred embodiment, the center metallic atom be titanium in metallocene compounds represented by the formulae $L^1M^1X_2$ and (III).

Organic aluminumoxy compounds which constitute metallocene-type catalyst are aluminooxanes and benzene-insoluble organic aluminumoxy compounds. Ionized ionic compounds which constitute metallocene-type catalysts are illustrated by Lewis acids, ionic compounds such as trialkyl substituted ammonium salts, N,N-dialkyl anilinium salts, dialkyl ammonium salts, and triarylphosphonium salts. Organic aluminum compounds and organic aluminumoxy compounds and/or ionized ionic compounds may be used together.

The copolymer (A) is prepared by copolymerizing ethylene and the other monomers, usually propylene, in the presence of the vanadium-type catalyst as described above. When a vanadium-type catalyst is employed the concentration of a soluble vanadium compound in the polymerization system is usually 0.01 to 5 millimole/liter, preferably 0.05 to 3 millimole/liter of polymerization volume. Desirably, a soluble vanadium compound is fed in a ten-fold or less, preferably 1-5 fold concentration of the concentration of the soluble vanadium compound present in the polymerization system. The organic aluminum compound is fed in such an amount that the molar ratio Al/V is 2 or more, preferably 3-20.

When a metallocene type catalyst is employed, the concentration thereof in the polymerization system is usually 0.00005 to 0.1 millimole/liter. The organic aluminumoxy compound is fed in such an amount that the Al/transition metal molar ratio in the metallocene compound in the polymerization system is 1 to 10,000.

The ionized ionic compound is fed in such an amount that the molar ratio of ionized compound to the metallocene compound is from 0.5 to 30. When the organic aluminum compound is used, it is usually used in amounts ranging from 0-5 millimole/liter of polymerization volume.

Polymerization in the presence of the vanadium-type catalyst is usually conducted at −50° C. to 100° C. and the pressure is greater than atmospheric, up to 50 kg/cm$^3$. Polymerization in the presence of the metallocene-type catalyst is usually at −20° C. to 150° C. and the pressure is greater than atmospheric, up to 80 kg/cm$^3$. Reaction times depend upon catalyst concentration and polymerization temperature, but typically range from 5 minutes to 5 hours.

Dispersant-viscosity improvers (DVI), that is, polymers having polar group containing monomers copolymerized with the monomers making up the ethylene copolymer or grafted onto the ethylene copolymer backbone are also contemplated.

The amount of polymer (A) in concentrates of the present invention is typically 1 to 30 percent by weight, or, functionally expressed, an amount suitable to lead to a reduction of the kinematic viscosity of the concentrate containing the component (B) polymer. Preferred amounts are 1 to 25 percent, 1 to 15 percent, 2 to 10 percent, 3 to 8 percent, and 4 to 6 percent by weight. When used in a fully formulated lubricant, typical amounts are correspondingly reduced, to, e.g., 0.05 to 1.5 percent, 0.2 to 1 percent, or 0.4 to 0.8 percent by weight.

The Vinyl Aromatic Block Copolymer

Another component (B) of the composition of the present invention is a block copolymer (which term is intended to include certain star copolymers) comprising a vinyl aromatic comonomer moiety and second comonomer moiety. Illustrative of such materials are hydrogenated diene/vinyl aromatic block copolymers, which typically can function as a viscosity improving agent. These copolymers are prepared from, first, a vinyl aromatic monomer. The aromatic portion of this monomer can comprise a single aromatic ring or a fused or multiple aromatic ring. Examples of fused or multiple aromatic ring materials include vinyl substituted naphthalenes, acenaphthenes, anthracenes, phenanthrenes, pyrenes, tetracenes, benzanthracenes, and biphenyls. The aromatic comonomer may also contain one or more heteroatoms in the aromatic ring, provided that the comonomer substantially retains its aromatic properties and does not otherwise interfere with the properties of the polymer. Such heteroaromatic materials include vinyl-substituted thiophene, 2-vinylpyridine, 4-vinylpyridines, N-vinylcarbazole, N-vinyloxazole, and substituted analogues thereof. More commonly the monomers are styrenes. Examples of styrenes include styrene, alpha-methyl styrene, ortho-methyl styrene, meta-methyl styrene, para-methyl styrene, and para-tertiary butyl styrene. The vinyl group in the vinyl aromatic monomer is commonly an unsubstituted vinyl (e.g., $CH_2{=}CH{-}$) group, or an equivalent group of such a nature that it provides adequate means for incorporation of the aromatic comonomer into the polymer chain as a "block" (or segment) of homopolymer, having a number of consecutive uniform repeating units, which imparts a high degree of aromatic content to the block. A preferred vinyl aromatic monomer is styrene.

The second monomeric component of this polymer can be any monomer capable of polymerizing with the vinyl aromatic comonomer. Examples of such monomers include dienes such as 1,3-butadiene, isoprene, chloroprene (thus providing vinyl aromatic/diene block copolymers), acrylate esters, methacrylate esters, and alkylene oxides. All of these monomers can be copolymerized with vinyl aromatic monomers to yield block polymers, usually under anionic conditions. Low temperatures are usually required with these monomers, particularly when acrylate or methacrylate esters are employed.

Conditions for block copolymerization of acrylate and methacrylate esters onto mono-and di-anionic polystyrene polymers are described in the Encyclopedia of Polymer Science and Engineering (1987 ed.) Vol. 2. Several techniques are employed in making vinyl aromatic block polymers, the most common of which involve the intermediacy of a "living" polystyrene segment having the anionic moiety at one or both ends of the molecule. The living anionic sites can then be used to graft the next type of block by addition or displacement reaction on the second type of monomer chosen.

Other types of monomers can undergo anionic polymerizations to form block copolymer by ring-opening reactions initiated by anionic polystyrene intermediates. These include epoxides, episulfides, anhydrides, siloxanes, lactones, and lactams. Nucleophilic attack on epoxide monomers by anionic polystyrenes, for example, can produce, in a polyoxyalkylene block, a polyether terminating an alkoxide group. Similar ring-opening polymerization of lactones can be used to introduce a polyester segment, and siloxanes can produce blocks of polysiloxane.

Particularly preferred comonomers for anionic copolymerization with the vinyl aromatic monomers are dienes. Dienes contain two double bonds, commonly located in conjugation in a 1,3 relationship. Olefins containing more than two double bonds, sometimes referred to as polyenes, are also considered to be included within the definition of "dienes" as used herein. Examples of such diene monomers include 1,3-butadiene and hydrocarbyl substituted butadienes such as isoprene and 2,3-dimethylbutadiene. These and numerous other monomers are well known and widely used as components of elastomers as well as modifying monomers for other polymers. Preferably the diene is a conjugated diene which contains from 4 to 6 carbon atoms. Examples of conjugated dienes include 1,3 butadiene and hydrocarbyl-substituted butadienes such as piperylene, 2,3-dimethyl-1,3-butadiene, chloroprene, and isoprene, with isoprene and butadiene being particularly preferred. Mixtures of such conjugated dienes are also useful. Hydrogenated styrene/isoprene block copolymers, in particular, are useful. In a hydrogenated aromatic/diene block copolymer, it is typically the diene monomer-containing block that is hydrogenated, the aromatic portion being generally more resistant to hydrogenation.

The vinyl aromatic monomer content of the (B) copolymers is typically 10% to 60% by weight, alternatively 15 to 60% or 30 to 60% by weight. The remaining comonomer content of these copolymers is typically 40% to 90%, or 40 or 50% to 85 or 70% by weight. In referring to the relative amount of vinyl aromatic monomer in the polymer (B), it is useful to refer to the total weight average molecular weight of that portion of the molecule derived from such monomers. This is typically 20,000 to 40,000 weight average molecular weight. This monomer portion may occur together in blocks or be otherwise distributed within the polymers. Thus, a polymer with a molecular weight of 100,000, which contains about 30% styrene monomers, would have a molecular weight of the styrene moiety of 30,000.

If the remaining comonomer, that is, other than the vinyl aromatic monomer, is an aliphatic conjugated diene, third and other monomers can also be present, normally in relatively small amounts (e.g., 5 to 20 percent), including such materials as $C_{2-10}$ olefin oxides, ϵ-caprolactone, and δ-butyrolactone. Since the vinyl aromatic-containing di-and tri-block copolymers are made by sequential addition and polymerization of the individual monomer components, the polymerization mixture will contain a large preponderance of only one of the monomers at any particular stage in the overall polymerization process. In comparison, in the manufacture of a random block copolymer, more than one monomer may be present at any particular stage of the polymerization.

Styrene-diene copolymers, as a preferred example, can be prepared by methods well known in the art. Such styrene/diene block polymers are usually made by anionic polymerization, using a variety of techniques, and altering reaction conditions to produce the most desirable features in the resulting ganometallic material such as an alkyl lithium, or the anion formed by electron transfer from a Group IA metal to an aromatic material such as naphthalene. A preferred organometallic material is an alkyl lithium such as sec-butyl lithium; the polymerization is initiated by addition of the butyl anion to either the diene monomer or to the styrene.

Alternatively, a living diblock polymer can be coupled by exposure to an agent such as a dialkyl-dichlorosilane. When the carbanionic "heads" of two A-B diblock living polymers are coupled using such an agent, precipitation of LiCl occurs to give an A-B-A triblock polymer of somewhat different structure than that obtained by the sequential monomer addition method described above, wherein the size of the central B block is double that of the B block in the starting living (anionic) diblock intermediate.

Block copolymers made by consecutive addition of styrene to give a relatively large homopolymer segment (A), followed by a diene to give a relatively large homopolymer segment (B), are referred to as poly-A-block-poly-B copolymers, or A-B diblock polymers.

Usually, one monomer or another in a mixture will polymerize faster, leading to a segment that is richer in that monomer, contaminated by occasional incorporation of the other monomer. In some cases, this can be used beneficially to build a type of polymer referred to as a "random block polymer", or "tapered block polymer. When a mixture of two different monomers is anionically polymerized in a non-polar paraffinic solvent, one will initiate selectively, and usually polymerize to produce a relatively short segment of homopolymer. Incorporation of the second monomer is inevitable, and this produces a short segment of different structure. Incorporation of the first monomer type then produces another short segment of that homopolymer, and the process continues, to give a more or less "random" alternating distribution of relatively short segments of homopolymers, of different lengths. Random block polymers are generally considered to be those comprising more than 5 such blocks. At some point, one monomer will become depleted, favoring incorporation of the other, leading to ever longer blocks of homopolymer, in a "tapered block copolymer."

Hydrogenation of the unsaturated block polymers initially obtained produces polymers that are more oxidatively and thermally stable. Reduction is typically carried out as part of the polymerization process, using finely divided, or supported, nickel catalyst. Other transition metals may also be used to effect the transformation. Hydrogenation is normally carried out to reduce approximately 94-96% of the olefinic unsaturation of the initial polymer. In general, it is preferred that these copolymers, for reasons of oxidative stability, contain no more than 5% and more preferably no more than 0.5% residual olefinic unsaturation on the basis of the total amount of olefinic double bonds present in the polymer prior to hydrogenation. Such unsaturation can be measured by a number of means well known to those of skill in the art, such as infrared or nuclear magnetic resonance spectroscopy. Most preferably, these copolymers contain no discernible unsaturation, as determined by the aforementioned-mentioned analytical techniques.

The (B) copolymers, and in particular styrene-diene copolymers, are, in a preferred embodiment, block copolymers in which a portion of the blocks are composed of homopolymer or homo-oligomer segments of the vinyl aromatic monomer and another portion of the blocks are composed of homopolymer or homo-oligomer segments of the diene monomer, as described above. The polymers generally possess a weight average molecular weight of at least greater than 50,000, preferably at least 100,000, more preferably at least 150,000, and most preferably at least 200,000. Generally, the polymers should not exceed a weight average molecular weight of 500,000, preferably 400,000, and more preferably 300,000. The weight average molecular weights can be determined as described above. The number average molecular weight for such polymers can be determined by several known techniques. A convenient method for such determination is by size exclusion chromatography (also known as gel permeation chromatography (GPC)) which additionally provides molecular weight distribution information, see W. W. Yau, J. J. Kirkland and D. D. Bly, "Modern Size Exclusion Liquid Chromatography", John Wiley and Sons, New York, 1979. The polydispersity (the $M_w/M_n$ ratio) of certain particularly suitable block polymers is typically between 1.0 and 1.2.

Among the monomers which can be used to prepare the (B) copolymers of the present inventions are 1,3-butadiene, 1,2-pentadiene, 1,3-pentadiene, isoprene, 1,5-hexadiene, and 2-chloro-1,3 butadiene, and aromatic olefins such as styrene, α-methyl styrene, ortho-methyl styrene, meta-methyl styrene, para-methyl styrene, and para-t-butyl styrene, and mixtures thereof. Other comonomers can be included in the mixture and in the polymer, which do not substantially change the character of the resulting polymer. The comonomer content can be controlled through the selection of the catalyst component and by controlling the partial pressure of the various monomers, as described in greater detail above.

Suitable styrene/isoprene hydrogenated regular diblock copolymers are available commercially from Infineum under the trade names Infineum™ SV140 (formerly Shellvis™ 40) ($M_w$ ca. 200,000), Infineum™ SF150 ($M_w$ ca. 150,000) and Infineum™ SV160 ($M_w$ ca. 150,000), as well as from Septon Company of America (Kuraray Group) under the trade names Septon™ 1020 (Mw ca. 150,000) and Septon™ 1001 (Mw ca. 200,000). Suitable styrene/1,3-butadiene hydrogenated random block copolymers are available from BASF under the trade name Glissoviscal™ ($M_w$ ca. 160,000-220,000). A more detailed description of certain of these polymers and their manufacture is found in U.S. Pat. No. 5,747,433, see column 3 lines 56 through column 8 line 62.

An alternative form of block copolymer useful in the present invention is star polymers. These are described in detail in various patents including U.S. Pat. No. 6,034,042, which discloses star polymers having tetrablock copolymer arms of hydrogenated polyisoprene-polybutadiene-polyisoprene with a block of polystyrene. Another such patent is U.S. Pat. No. 5,458,791, which discloses star polymers having triblock copolymer arms of hydrogenated polyisoprene and polystyrene wherein the polystyrene is placed near the core of the star polymer. Such polymers are available from Infineum under the name Shellvis™ 250, -260, or -300. Suitable star polymers, thus, include hydrogenated styrene/butadiene star polymers and hydrogenated styrene/isoprene polymers.

In concentrate compositions, particularly in mineral oil, the amount of the hydrogenated diene/vinyl aromatic block copolymer is typically 1 to 30 percent by weight, often 1 to 25 or 1 to 15 percent by weight. At concentrations much below 1% the polymer is soluble in the oil without exhibiting unduly increased viscosity due to association, so that certain of the anti-thickening advantages of the present invention are not fully realized, although the improved viscometric properties described below will still be apparent. At concentrations much above 15-30% the composition can exhibit increased viscosity and certain difficulties in handling, even in the presence of component (A) of the present invention. A preferred concentration range of component (B) is 2 to 12 percent by weight; more preferably 4 to 8 or 5 to 7 percent, in a concentrate. In a fully formulated lubricant, the concentration of component (B) will be correspondingly reduced, to, e.g., 0.05 to 1.5 percent, 0.2 to 1 percent, or 0.4 to 0.8 percent by weight.

The relative weight ratios of polymers (A) and (B), whether in a concentrate or a fully formulated lubricant, are typically 20:80 to 60:40, or 30:70 to 50:50, or 35:65 to 45:55, or about 40:60 or, in other embodiments, 10:(0.1-10), or 1.0:(0.2-5), or 1.0:(0.5-2).

In another embodiment, the mixture of polymers (A) and (B) can be provided as a solid blend of the above-described polymers, with little or no diluent. The solid blend can be a mixture of particles of each of the polymers or it can comprise particles which are themselves a blend (e.g., by melt blending) of the individual polymers. The amounts and ratios of the polymers (A) and (B) will be as described above. The solid particles can be employed by dissolving them in an oil of lubricant viscosity or in another diluent liquid.

The polymer content (A) and (B) of a polymeric viscosity improver concentrate is typically 5-40% by weight, in a mineral oil, synthetic hydrocarbon, or ester diluent. With non-associative polymers, such as olefin copolymers, ethylene/propylene/diene (EPDM) polymers, butyl polymers, or polymethacrylates, concentrates can be prepared at relatively high concentrations without experiencing unduly high bulk viscosities. The styrene-diene block copolymers, however, are highly associative through, it is speculated, the mutual affinity of their polystyrene segments, so that the amount of polymer that can be dissolved before the concentrate viscosity become too great to pour, is relatively low. The association problem is exacerbated by the use of nonpolar mineral oils or synthetic hydrocarbon diluents that are themselves relatively poor solvents for the polystyrene segments in the block copolymers. In these diluents, the degree of association is relatively high.

In the present invention, the additional presence of polymer (A) along with polymer (B) prevents or minimizes the thickening that would otherwise result from the presence of (B) in a relatively high concentration, as found in a concentrate. Another group of advantages of the present invention is that the present polymer blends, when in the relatively more dilute form of a fully blended lubricant, exhibit excellent viscometric properties, including excellent low temperature properties such as Cold Crank Simulator test (CCS) (ASTM D-5293), Mini Rotary Viscometer test (MRV) (ASTM D-4684), and Scanning Brookfield Viscosity (ASTM D-5133], as well as high temperature properties as high temperature high shear stability (HTHS) (ASTM D-4683)], thickening performance upon addition of the polymer, and also substantially lower (improved) shear stability index (SSI) (ASTM D-6278).

The Oil of Lubricating Viscosity

The lubricating compositions and methods of this invention employ an oil of lubricating viscosity, including natural or synthetic lubricating oils and mixtures thereof. Mixture of mineral oil and synthetic oils, particularly polyalphaolefin oils and polyester oils, are often used.

Natural oils include animal oils and vegetable oils (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity. Oils of lubricating viscosity derived from coal or shale are also useful. Synthetic lubricating oils include hydrocarbon oils and halosubstituted hydrocarbon oils such as polymerized and interpolymerized olefins and mixtures thereof, alkylbenzenes, polyphenyl, (e.g., biphenyls, terphenyls, and alkylated polyphenyls), alkylated diphenyl ethers and alkylated diphenyl sulfides and their derivatives, analogs and homologues thereof. Hydrotreated naphthenic oils are also well known.

Alkylene oxide polymers and interpolymers and derivatives thereof, and those where terminal hydroxyl groups have been modified by, for example, esterification or etherification, constitute other classes of known synthetic lubricating oils that can be used.

Another suitable class of synthetic lubricating oils that can be used comprises the esters of dicarboxylic acids and those made from $C_5$ to $C_{12}$ monocarboxylic acids and polyols or polyol ethers.

Other synthetic lubricating oils include liquid esters of phosphorus-containing acids, polymeric tetrahydrofurans, silicon-based oils such as the polyalkyl-, polyaryl-, polyalkoxy-, or polyaryloxy-siloxane oils, and silicate oils.

Unrefined, refined and rerefined oils, either natural or synthetic (as well as mixtures of two or more of any of these) of the type disclosed hereinabove can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

Moreover, the oil of lubricating viscosity can be any of the API Base Oil Category Groups I-V oils, including Group I (>0.03% S and/or <90% saturates, viscosity index 80-120), Group II (≦0.03% S and ≧90% saturates, V.I. 80-120), Group III (≦0.03% S and ≧90% saturates, V.I.≧120), Group IV (all polyalphaolefins), or Group V (all others) or mixtures thereof. Oils of Groups II, III, and IV are particularly useful.

The lubricating oil in the invention, when present in a concentrate-forming amount, will normally comprise the major amount of the composition. Thus it will normally be at least 50% or 60% by weight of the composition, preferably 70 to 96%, and more preferably 84 to 93%. The oil can comprise the balance of the composition after accounting for components (a) and (b) described above and any optional additives.

Other Additives

The compositions of this invention may contain minor amounts of other components. The use of such additives is optional and the presence thereof in the compositions of this invention will depend on the particular use and level of performance required. The compositions may comprise a friction modifier, such as a zinc salt of a dithiophosphoric acid. Zinc salts of dithiophosphoric acids are often referred to as zinc dithiophosphates, zinc O,O-dihydrocarbyl dithiophosphates, and other commonly used names. They are sometimes referred to by the abbreviation ZDP. One or more zinc salts of dithiophosphoric acids may be present in a minor amount to provide additional extreme pressure, anti-wear and anti-oxidancy performance.

In addition to zinc salts of dithiophosphoric acids discussed herein-above, other additives that may optionally be used in the lubricating oils of this invention include, for example, detergents, dispersants, auxiliary viscosity improvers, oxidation inhibiting agents, metal passivating agents, pour point depressing agents, extreme pressure agents, anti-wear agents, color stabilizers and anti-foam agents.

Extreme pressure agents and corrosion and oxidation inhibiting agents which may be included in the compositions of the invention are exemplified by chlorinated aliphatic hydrocarbons, organic sulfides and polysulfides, phosphorus esters including dihydrocarbon and trihydrocarbon phosphites, and molybdenum compounds.

Auxiliary viscosity improvers (also sometimes referred to as viscosity index improvers) may be included in the compositions of this invention. Viscosity improvers are usually polymers, including polyisobutenes, polymethacrylic acid esters, diene polymers, polyalkyl styrenes, alkenylarene-conjugated diene copolymers and polyolefins. Multifunctional viscosity improvers, which have dispersant and/or antioxidancy properties are known and may optionally be used. Such products are described in numerous publications.

Pour point depressants are a particularly useful type of additive often included in the lubricating oils described herein. See for example, page 8 of 'Lubricant Additives" by C. V. Smalheer and R. Kennedy Smith (Lezius-Hiles Company Publisher, Cleveland, Ohio, 1967). Examples of pour point depressants are polyacrylates, alkylated naphthalenes, styrene/alkyl maleate and fumarate- and maleate ester/vinyl acetate copolymers.

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125-162.

Detergents and dispersants may be of the ash-producing or ashless type. The ash-producing detergents are exemplified by oil soluble neutral and basic salts, wherein "basic salt" is used to designate metal salts wherein the metal is present in stoichiometrically larger amounts than the organic acid radical, of alkali or alkaline earth metals with sulfonic acids, carboxylic acids, phenols or organic phosphorus acids characterized by at least one direct carbon-to-phosphorus linkage. Basic salts and techniques for preparing and using them are well known to those skilled in the art and need not be discussed in detail here. The extent of overbasing resulting in a basic salt is indicated by the term metal ratio (MR) which indicates the number of equivalents of base per equivalent of acid.

Ashless detergents and dispersants are so-called despite the fact that, depending on its constitution, the detergent or dispersant may upon combustion yield a nonvolatile residue such as boric oxide or phosphorus pentoxide; however, it does not ordinarily contain metal and therefore does not yield a metal-containing ash on combustion. Moreover, such materials may interact metal salts when used in a lubricant formulation so that the material is no longer free from metal. These materials are nevertheless commonly referred to as "ashless." Many types are known in the art, and any of them are suitable for use in the lubricants of this invention. The following are illustrative: (1) Reaction products of carboxylic acids (or derivatives thereof) containing at least 34 and preferably at least 54 carbon atoms with nitrogen containing compounds such as amine, organic hydroxy compounds such as phenols and alcohols, and/or basic inorganic materials. Examples of these "carboxylic dispersants" are described in many U.S. patents including U.S. Pat. No. 3,541,678. (2) Reaction products of relatively high molecular weight aliphatic or alicyclic halides with amines, preferably polyalkylene polyamines. These may be characterized as "amine dispersants" and examples thereof are described, for example, in U.S. Pat. No. 3,275,554. (3) Reaction products of alkyl phenols in which the alkyl groups contains at least 30 carbon atoms with aldehydes (especially formaldehyde) and amines (especially polyalkylene polyamines), which may be characterized as "Mannich dispersants". The materials described in U.S. Pat. No. 3,413,347 are illustrative. (4) Products obtained by post-treating the carboxylic amine or Mannich dispersants with such reagents are urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the U.S. Pat. No. 4,234,435. (5) Interpolymers of oil-solubilizing monomers such as decyl methacrylate, vinyl decyl ether and high molecular weight olefins with monomers containing polar substituents, e.g., aminoalkyl acrylates or methacrylates, acrylamides and poly-(oxyethylene)-substituted acrylates. These may be characterized as "polymeric dispersants" and examples thereof are disclosed, for instance, in U.S. Pat. No. 3,329,658.

The above-illustrated additives may each be present in lubricating compositions at a concentration of as little as 0.001% by weight usually ranging from 0.01% to 20% by weight, more often from 1% to 12% by weight.

Lubricating Oil Compositions

The lubricating oil compositions of this invention contain a major amount of an oil of lubricating viscosity and a minor amount, usually 0.1 to 2% by weight of the mixture of polymers (A) and (B) on a neat, diluent-free basis, preferably 0.5 to 1.5% by weight. The components making up the mixture of polymers may also be added, individually, to the oil of lubricating viscosity. In this event, the relative amounts of components added individually are in the same ratio that is used in the mixture.

Additive Concentrates

The mixture of this invention may be present as a component of an additive concentrate. Additive concentrates comprise the mixtures of this invention, optionally together with other performance improving additives in concentrated form, usually in the presence of a substantially inert, normally liquid, organic diluent. A wide variety of diluents such as hydrocarbon solvents and oils are useful diluents. More often, the diluent is an oil of lubricating viscosity.

Typically, the mixtures of this invention are present in additive concentrates in amounts of 1% to 50% by weight, often to 20% based on the total weight of the additive concentrate. Not all lubricant manufacturers are capable of handling solid polymers so it is frequently necessary to provide the polymeric mixture in a liquid form that can be handled without specialized equipment. The purpose of supplying the mixture in concentrated form is to reduce the cost of shipping the polymer containing mixture to the end user. The additive concentrate typically contains the maximum amount of active materials (polymer and other performance improving additives) keeping in mind the need to be able to handle, e.g., pump, pour, or otherwise deliver the concentrate. The consistency of the additive concentrate will depend upon the amount of polymer present therein and can range from liquid to gel to solid. Thus, the amount of polymer contained in the additive concentrate frequently will depend upon the ability of the lubricant blender to handle the concentrate.

Often, the polymer composition and additive concentrates containing same will contain a small amount, typically 0.01% to 1% by weight of an antioxidant such as a hindered phenol or an aromatic amine.

The mixture may be prepared in neat, essentially diluent-free form by mixing the diluent-free individual polymer components. Such mixing typically requires specialized equipment, for example equipment that allows the components to be combined by milling, calendering, or extrusion, are all useful for preparing essentially diluent-free mixtures.

Another means for preparing diluent-free polymer mixtures is to dissolve the polymers, individually or together in a solvent in which each polymeric component is soluble, then to remove the solvent from the polymer containing solution by evaporation, stripping the solvent by heating the solution, frequently under reduced pressure, precipitating the polymeric mixture from the solution by chilling the solution to a temperature at which the polymeric mixture is no longer soluble, or to precipitate the polymeric mixture from the solution by mixing the polymer containing solution with another solvent in which the polymeric mixture is insoluble or has only limited solubility or other techniques well known to those skilled in the art.

The mixtures, concentrates, and lubricants described herein are useful for lubricating internal combustion engines, which can include four-stroke, two-stroke, spark ignited, or ignition ignited engines, for passenger cars, heavy duty diesel applications such as trucks and construction machinery, stationary gas engines, small, portable engines, and marine diesel engines. In each case a lubricant containing the present compositions is supplied to the engine, and the engine is operated.

It is known that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not susceptible of easy description. Nevertheless, all such modifications and reaction products are included within the scope of the present invention; the present invention encompasses the composition prepared by admixing the components described above.

The following examples demonstrate the principles of this invention.

EXAMPLE 1

Blends are prepared of a 50:50 mixture by weight of polymers (A) and (B). Polymer A is first dissolved in a 150N mineral oil containing 0.1% of a butylated hydroxytoluene (BHT) antioxidant. The antioxidant is added to the mineral oil at room temperature. Polymer A, which is in a pellet from, is slowly added to the oil while it is being heated and stirred under high agitation. After all the polymer A has has been added, the oil is continued to be heated to 130° C. and is maintained at that temperature until all the Polymer A pellets are fully dissolved. Polymer B, which is also in a pellet form, is then added to the oil with strong agitation at 130° C. until all of Polymer B is fully dissolved. The blends are maintained at 130° C. under strong agitation for an additional two hours to ensure that all the polymers are fully soluble.

Polymer (A) is an ethylene-propylene copolymer with an ethylene level of 75 wt-%., a $\overline{M}_w$ of ca. 88,000, and an SSI of 8. It has a crystallinity of 22%, a density of 867 kg/m$^3$, and a melting point of 38° C. Polymer (B) is Septon™ 1020, a hydrogenated segmented styrene-isoprene (35 wt. % styrene) diblock copolymer, $\overline{M}_w$ ca. 150,000, from Septon Company of America.

EXAMPLES 2-7 AND COMPARATIVE EXAMPLE C1

Concentrates of the polymer blend from Example 1 are prepared in a mineral oil at the total concentrations (A)+(B) as shown in the following table. For comparison, a sample of Septon™ 1020 is also prepared at a 5.8 weight percent concentration. The kinematic viscosity (D445_100) of each of the concentrates at 100° C. is measured, and the results presented in units of mm$^2$sec$^{-1}$ (cSt).

| | Example (Concentrate) | | | | | | |
|---|---|---|---|---|---|---|---|
| | 2 | 3 | 4 | 5 | 6 | 7 | Comparative Ex. C1 |
| Polymers | 6% blend | 7% blend | 8% blend | 9% blend | 10% blend | 11% blend | 5.8% Septon ™ 1020 |
| Viscosity | 82 | 147 | 207 | 243 | 360 | 631 | >10,000 |

EXAMPLES 8-14 AND COMPARATIVE EXAMPLES C2 AND C3

A concentrate containing a 50:50 blend of polymers as in Example 1 is added to oil formulations using a base oil and additive package as indicated below, to form lubricants containing the polymer blend. The viscosity at 100° C. is measured before and after shearing under the conditions of ASTM D6278_30 (30 pass shear stability test) and the Shear Stability Index (SSI) is calculated.

| | Example: | | | | | | | | |
|---|---|---|---|---|---|---|---|---|---|
| | 8 | 9 | 10 | C2 | 11 | 12 | 13 | 14 | C3 |
| Base oil[a] | 200 N | 200 N | 200 N | 200 N | 200 N | 200 N | PAO | PAO | PAO |
| Additives[b] | P | P | P | P | none | none | Q | Q | Q |
| Polymer, | blend | blend | blend | Sep. | blend | blend | blend | blend | Sep. |
| % concen- | 1 | 1.17 | 1.34 | 1020 | 1.50 | 1.67 | 1.24 | 1.31 | 1020 |
| tration | | | | 0.97 | | | | | 0.96 |
| Viscosity: initial | 12.88 | 14.21 | 15.02 | 14.45 | 11.3 | 11.8 | 10.6 | 10.9 | 10.5 |
| after shear | 12.86 | 14.22 | 14.99 | 14.12 | 11.1 | 11.7 | 10.5 | 10.7 | 9.6 |
| % vis. loss | 0.16 | 0 | 0.2 | 2.3 | 1.98 | 1.03 | 0.89 | 1.38 | 8.2 |
| SSI | 1.0 | 0 | 0.5 | 8.9 | 2.4 | 1.3 | 1.1 | 1.7 | 10.4 |

[a]"200 N": 200 Neutral API Group I oil; "PAO": a blend of polyalphaolefin synthetic oil with Group III mineral oils
[b]P and Q are two different commercial additive packages. "Sep." = Septon ™

EXAMPLES 15-21 AND COMPARATIVE EXAMPLE C4 AND C5

Fully formulated compositions are prepared using a blended base oil of polyalphaolefins and API Group III mineral base oils and conventional additives. The compositions are subjected to the following tests and measurements: Kinematic viscosity at 100° C. (in $mm^2/s$ (cSt)); High Temperature High Shear viscosity (HTHS, ASTM D 4683, in mPa-s); CCS (cold crank simulator) Viscosity (ASTM D5293, average of 2 runs, in mPa-s), and MRV (mini-rotary viscometer, ASTM D4684) at −40° C. (in mPa-s).

| | Example: | | | | | | | | |
|---|---|---|---|---|---|---|---|---|---|
| | 15 | 16 | 17 | 18 | 19 | 20 | 21 | C4 | C5 |
| Polymer, | blend[a] | blend[a] | blend[a] | blend[a] | blend[a] | blend[a] | blend[a] | Septon | Septon |
| % conc. | 0.9 | 1.05 | 1.2 | 1.24 | 1.31 | 1.35 | 1.50 | 1020 | 1020 |
| | | | | | | | | 0.9 | 0.96 |
| Viscosity, 100° C. | 9.2 | 10.0 | 10.4 | 10.6 | 10.9 | 10.7 | 11.3 | 10.0 | 10.5 |
| HTHS viscosity | 2.88 | 3.04 | 3.17 | 3.30 | 3.25 | 3.34 | 3.50 | 2.84 | 2.89 |
| CCS −30° C. viscosity | 5 937 | 6 114 | 6 219 | 6 011 | 5 983 | 6 431 | 6 551 | 5 911 | 5 864 |
| MRV −40° C. viscosity | 14 300 | 14 800 | 15 400 | 15 000 | 14 700 | 15 200 | 16 500 | 18 000 | 18 500 |

[a]50:50 blend as in Example 1

The results show that, when in diluted solution (about 1 percent by weight) all of the polymer solutions exhibit acceptable viscosity, but in concentrated solutions, the styrene-based block copolymer imparts excessive viscosity, a problem which is solved by employing the blend of the present invention. Moreover, the shear stability of the formulations containing the blends of the present invention is significantly better than that of those containing the ethylene propylene copolymer (Polymer A) or the styrene-based block copolymer (Polymer B) alone. This is an unexpected result because the SSI of blended polymers is understood to normally reflect the proportional contribution of the SSI of the individual components in the blends.

The results further show that lubricant formulations containing blends of the present invention exhibit good (low) CCS viscosity and superior (lower) MRV viscosity at −40° C. compared with the styrene-based block polymer. They also show improved (higher) high temperature high shear viscosity.

EXAMPLES 22-26 AND COMPARATIVE EXAMPLE C6 AND C7

Concentrates containing various ratios of Polymer A and B (from Example 1) are prepared according to the procedure described in Example 1. Fully formulated compositions are prepared using the concentrates, a blended base oil of API Group III mineral oil and polyalphaolefins, and conventional additives and are tested using the tests and procedures described above. Results are shown in the following table:

| | Example | | | | | | |
|---|---|---|---|---|---|---|---|
| | C6 | 22 | 23 | 24 | 25 | 26 | C7 |
| A/B Ratio | 100/0 | 50/50 | 45/55 | 40/60 | 35/65 | 30/70 | 0/100 |
| % Polymer in Concentrate | 15 | 11.0 | 10.8 | 10.5 | 10.3 | 10.1 | 6.0 |
| % Conc. in Engine oil | 10.5 | 10.5 | 10.5 | 10.5 | 11.3 | 10.5 | 15.5 |
| % Polymer in Engine Oil | 1.58 | 1.16 | 1.13 | 1.10 | 1.16 | 1.06 | 0.93 |
| Visc @ 100° C. $mm^2/s$ | 10.5 | 10.4 | 10.3 | 10.3 | 10.2 | 10.2 | 10.4 |
| HTHS $mm^2/s$ | 3.74 | 3.12 | 3.05 | 3.08 | 3.13 | 3.04 | 2.87 |
| CCS at −35° C. mPa-s | 6 586 | 6 125 | 6 125 | 5 992 | 6 098 | 6 230 | 6 431 |
| MRV at −40° C. mPa-s | 21 600 | 15 100 | 15 300 | 15 700 | 15 300 | 16 100 | 23 100 |
| SSI | 10.4 | 1.5 | 0.1 | 0.9 | 0.3 | 2.6 | 9.5 |

The results show that blends of A and B, when in diluted solution (about 1.1 percent by weight) in engine oil formulations exhibit cold temperature properties (CCS and MRV) which are better (lower viscosity) than formulations containing either the ethylene propylene copolymer (Polymer A) or the styrene-based block copolymer (Polymer B) alone. This is an unexpected result because the properties of blended polymers normally reflect the proportional contribution of the individual components in the blends.

The results further show that lubricant formulations containing blends of the present invention exhibit Shear Stability Indices (SSI) which are better (lower) than formulations containing the ethylene propylene copolymer (Polymer A) or the styrene-based block copolymer (Polymer B) alone. Again, this is an unexpected result as the SSI of the blends of polymers usually reflect the proportional contribution of the individual components in the blends.

Each of the documents referred to above is incorporated herein by reference. Except in the examples, or where otherwise explicitly indicated, all numerical quantities in this description specifying amounts of materials, reaction conditions, molecular weights, number of carbon atoms, and the like, are to be understood as modified by the word "about". Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the upper and lower amount, range, and ratio limits set forth herein may be independently combined. As used herein, the expression "consisting essentially of" permits the inclusion of substances which do not materially affect the basic and novel characteristics of the composition under consideration.

What is claimed is:

1. A lubricant composition comprising:

an oil of lubricating viscosity;

(A) about 0.05 to about 1.5 percent by weight of a copolymer comprising about 70 to about 79 percent by weight of units derived from ethylene ("E"), having a $\overline{M}_w$ of about 50,000 to about 100,000, $\overline{M}_w/\overline{M}_n$ less than about 3, density ("D") of about 860 to about 896 $kg/m^3$, and a melting point ("$T_m$") of about 15° C. to about 60° C., wherein E and $T_m$ fulfill the expression $$3.44E-206 \geqq T_m;$$

and (B) about 0.05 to about 1.5 percent by weight of a block copolymer comprising a first block which comprises a vinyl aromatic comonomer and a second block which comprises a diene comonomer, the diene monomer-containing block being hydrogenated, wherein vinyl aromatic monomer content of the block conolymer (B) is about 10 to about 60 weight percent;

wherein the weight ratio (A):(B) is about 20:80 to about 60:40, wherein the block copolymer (B) comprises at least one homopolymer or homo-oligomer segment of the vinyl aromatic monomer, and wherein the block copolymer (B) is a star polymer.

2. The composition of claim 1 wherein the star polymer (B) is a hydrogenated styrene/butadiene polymer or a hydrogenated styrene/isoprene polymer.

3. The lubricant composition of claim 1 wherein the ethylene/olefin copolymer is a binary copolymer.

4. The composition of claim 1 wherein the copolymer of (A) is an ethylene/propylene copolymer.

5. The composition of claim 1 wherein the $\overline{M}_w$ of the copolymer of (A) is greater than about 75,000.

6. The composition of claim 1 wherein copolymer of (A) has a degree of crystallinity of 20 to 30%.

7. The composition of claim 1 wherein the density (D) of the copolymer and the melting point ($T_m$) fulfill the expression $$T_m \geqq 1247D-1037.$$

8. The composition of claim 1 wherein the block copolymer (B) has a weight average molecular weight of about 50,000 to about 500,000.

9. The composition of claim 8 wherein the weight average molecular weight of the total vinyl aromatic monomer component of the block copolymer is about 20,000 to about 40,000.

10. The lubricant composition of claim 1 wherein the block copolymer (B) further comprises at least one homopolymer or homo-oligomer segment of the diene monomer.

11. The composition of claim 1 further comprising at least one additional additive selected from the group consisting of friction modifiers, detergents, dispersants, oxidation inhibiting agents, metal passivating agents, pour point depressing agents, extreme pressure agents, and auxiliary viscosity improvers.

12. A method for lubricating an internal combustion engine, comprising supplying thereto the composition of claim 1.

* * * * *